US005512212A

United States Patent [19]

Brown et al.

[11] Patent Number: 5,512,212

[45] Date of Patent: Apr. 30, 1996

[54] CORROSION INHIBITOR COMPOSITION AND METHOD OF USE

[75] Inventors: J. Michael Brown, The Woodlands, Tex.; James R. Ohlsen, Ventura, Calif.; Richard D. McBride, Sugar Land, Tex.

[73] Assignee: Betz Laboratories, Inc., Trevose, Pa.

[21] Appl. No.: 373,708

[22] Filed: Jan. 17, 1995

Related U.S. Application Data

[62] Division of Ser. No. 202,403, Feb. 25, 1994, Pat. No. 5,415,805.

[51] Int. Cl.[6] ..... C23F 11/18

[52] U.S. Cl. ..... 252/387; 252/389.62; 252/389.54; 252/390; 252/392; 252/394; 252/396; 252/389.23; 422/16; 422/17; 422/18; 422/19; 507/939

[58] Field of Search ..... 252/389.54, 389.23, 252/389.61, 389.62, 390, 394, 392, 396, 387, 68, 74, 75; 208/47; 210/699, 700, 701; 422/16, 17, 18, 19; 507/939

[56] References Cited

U.S. PATENT DOCUMENTS

| | | | |
|---|---|---|---|
| 2,150,926 | 3/1939 | Morgan | 252/77 |
| 2,566,924 | 9/1951 | Burghart | 252/74 |
| 2,795,552 | 6/1957 | Abbott et al. | 252/74 |
| 3,030,308 | 5/1962 | Agnew et al. | 252/74 |
| 3,057,799 | 10/1962 | Wilkey | 252/33.4 |
| 3,189,537 | 6/1965 | Carlton | 208/47 |
| 3,432,437 | 3/1969 | Nail | 252/49.9 |
| 3,629,104 | 12/1971 | Maddox, Jr. | 507/243 |
| 3,758,493 | 9/1973 | Maddox, Jr. | 548/348.1 |
| 3,819,328 | 6/1974 | Go | 208/47 |
| 3,969,281 | 7/1976 | Sharp | 252/542 |
| 4,176,059 | 11/1979 | Suzuki | 210/97 |
| 4,371,447 | 2/1983 | Webb et al. | 252/73 |
| 4,388,214 | 6/1983 | Oppenlaender et al. | 208/47 |
| 4,497,713 | 2/1985 | Geiger | 210/699 |
| 4,554,098 | 11/1985 | Jones | 252/181 |
| 4,561,990 | 12/1985 | Darden | 252/74 |
| 4,584,119 | 4/1986 | Duranleau et al. | 252/74 |
| 4,699,726 | 10/1987 | Nolin et al. | 252/75 |
| 4,842,716 | 6/1989 | Kaplan et al. | 208/47 |
| 4,963,290 | 10/1990 | Bressan et al. | 252/74 |
| 5,062,992 | 11/1991 | McCullough | 252/394 |
| 5,071,580 | 12/1991 | Little | 252/74 |
| 5,080,818 | 1/1992 | Tachiiwa et al. | 252/74 |
| 5,100,571 | 3/1992 | Hartman | 252/74 |
| 5,151,220 | 9/1992 | Majestic et al. | 252/392 |
| 5,240,631 | 8/1993 | Mascioli et al. | 208/74 |
| 5,300,235 | 5/1994 | Crewlow et al. | 208/47 |
| 5,366,651 | 11/1995 | Maes et al. | 252/74 |
| 5,387,360 | 2/1995 | Uekusa et al. | 252/74 |
| 5,405,546 | 4/1995 | Jolley et al. | 252/68 |
| 5,415,805 | 5/1995 | Brown et al. | 252/387 |

OTHER PUBLICATIONS

EP 196202, (Nolin et al.) 1, Oct. 1986, see Chemical Abstract 105:229241 only.

JP 63258980 A2 (Sugyama, Kunio) 26 Oct. 1988. See Chemical Abstract 110:98901 only.

CS 246633 B1 (Holub et al.) 16, Nov. 1987. See Chemical Abstract 109:173382 only.

JP 60243185 A2 (Kamei et al.) 17, May 1984. See Chemical Abstract 104:151272 only.

WO 8909806 A1 (Reny et al.) 19 Oct. 1989. See Chemical Abstract 112:9747 only.

JP 02292386 A2 (Tsujii et al.) 3, Dec. 1990. See Chem Abstract 114:146207 only.

JP 6024778 A2 (Kamei et al.) 29, Nov. 19985. See Chemical Abstract 104:152210 only.

JP 60243189 A2 (Watanabe, Hiroyuki) 17 May 19984. See Chemical Abstract 104:210098 only.

EP 299942 A2 (Tachiiwa et al.) 18 Jan. 1989, See Chem. Abstract 111:10119 only.

EP 329560 A1 (Bresson, Joelle et al.) 23 Oct.1989, See Chem Abstract 112:9123 only.

EP 34982 A1 (Barraud et al.) 28 Jun. 1989, see Chemical Abstract 112:142639 only.

JP 01304176 A2 (Tateiwa et al.) 7 Dec. 1989, see Chem. Abstract 113:135571 only.

DE 4204809 A1 (Pfitzner et al.) 19 Oct. 1993, see Chem. Abstract 119:206942 only.

EP 42937 Al (Hirozawa, Stanley) 06 Jan. 1982, see Chem. Abstract 96:185991 only.

FR 2622594 A1 (Rolland et al.) 05 May 1989, see Chem Abstract 111:216407 only.

The Current State of Corrosion Control: Technologies and Costs, Schock and Clark, Proc. Water Technology Conf. 1989; pp. 577–604.

Development of an All Organic Ferrous Metal Corrosion Inhibitor, Yeoman and Harris, Corrosion 86; pp. 14/1–6.

*Primary Examiner*—Gary Geist
*Assistant Examiner*—Valerie Fee
*Attorney, Agent, or Firm*—Alexander D. Ricci; Philip H. Von Neida

[57] ABSTRACT

A composition and method for inhibiting corrosion of iron and iron-containing metals in contact with aqueous systems containing sulfide compounds. The composition comprises (A) an aqueous solution of an alcohol, an acid, a fatty imidazoline, and an ethoxylated fatty diamine, and (B) an aqueous solution of a molybdate compound or salt thereof.

6 Claims, No Drawings

CORROSION INHIBITOR COMPOSITION AND METHOD OF USE

This is a divisional of application Ser. No. 08/202,403 filed Feb. 25, 1994, now U.S. Pat. No. 5,415,805.

FIELD OF THE INVENTION

This invention relates to compositions and methods for inhibiting the corrosion of iron and iron-based metals in sulfur mines.

BACKGROUND OF THE INVENTION

Sulfur is employed in a number of industrial processes such as sulfuric acid production and the vulcanization of rubber. Most sulfur is obtained from deposits buried underground by a variety of mining techniques. One method is the Frasch process where large quantities of superheated hot water, steam and compressed air are used to recover elemental sulfur through wells drilled into buried deposits of native sulfur. The water is heated and pumped down bore holes and forced into sulfur deposits. The elemental sulfur melts and then is forced to the surface by the water pressure and compressed air where it is recovered.

The sulfur can exist as sulfides and polysulfides as well as organic sulfur compounds. At the high temperatures associated with the Frasch process, corrosive waters containing sulfides and polysulfides exist. These sulfur-bearing waters can be very corrosive towards iron and iron-based metallurgies present in the mining operation. The subsequent corrosion of the pipes, valves and conduits composed of iron and iron-based metals can become costly due to replacement parts and downtime during the mining operation.

SUMMARY OF THE INVENTION

This invention relates to a corrosion inhibiting composition and method of use comprising a combination of an aqueous solution of an alcohol, an acid, a fatty imidazoline and an ethoxylated fatty diamine, and an aqueous solution of a molybdate compound or salt thereof.

This composition provides effective corrosion inhibition of iron and iron-based metallurgies in contact with aqueous systems containing sulfide and polysulfide compounds.

DESCRIPTION OF THE RELATED ART

The cost-saving and health concerns of metal corrosion are discussed in The Current State of Corrosion Control: Technologies and Costs, Schock and Clark, Proc. Water Technol. Conf. 1989, pp. 575–604. Metal corrosion control methods include the use of treatment chemicals such as polyphosphates, silicates and orthophosphates.

Development of an All Organic Ferrous Metal Corrosion Inhibitor, Yeoman and Harris, Corrosion 86, pp 14/1–6 discusses the use of organic corrosion inhibitors instead of chromate, zinc and inorganic phosphate programs. Hydroxyphosphonic acid with carboxylate functionality proved effective for ferrous metal corrosion.

DETAILED DESCRIPTION OF THE INVENTION

The present invention pertains to corrosion inhibiting compositions and methods for iron and iron-based metallurgies comprising a combination of (A) an aqueous solution of an alcohol, an acid, a fatty imidazoline, and an ethoxylated fatty diamine, and (B) an aqueous solution of a molybdate compound or salt thereof.

The composition provides an effective corrosion inhibitor for iron and iron-based metallurgies in contact with aqueous systems containing sulfur compounds. These compositions prove effective in sulfur mining operations where water containing sulfide and polysulfide compounds is in contact with the iron and iron-based metallurgies.

The alcohols useful in this invention are those that are water-soluble. Preferably, these alcohols are diethylene glycol monobutyl ether, butanol, butyl cellusolve, isopropanol, methanol, propylene glycol, 2-ethylhexanol, hexylene glycol, and glycolic acid.

The acids useful in this invention can be either organic or inorganic acids, preferably acetic acid or orthophosphoric acid. The inventors anticipate that fatty-substituted organic acids, glycolic acid and mono-, di-, or tricarboxylic acids or mixtures thereof will also be effective in the present invention.

The fatty imidazoline is preferably a tall oil fatty substituted imidazoline. These imidazolines are those compounds or mixtures of compounds prepared from long chain fatty acids, such as tall oil fatty acid, stearic acid, or oleic acid, or mixtures thereof and polyamines such as ethylenediamine, diethylenetriamine, triethylenetetramine or tetraethylenepentamine. The imidazoline employed in the examples was prepared by known methods from tall oil fatty acids and diethylenetriamine with a molar ratio of about 1.5:1. This reaction is disclosed in U.S. Pat. No. 5,062,992, which disclosure is wholly incorporated by reference herein.

The ethoxylated fatty diamine compound is preferably a tallowdiamine with 10 moles of ethylene oxide.

The molybdate compound may be derived from its salt. The preferred molybdate compound is sodium molybdate dihydrate.

The preferred formulary of (A) comprises 22% water, 20% diethylene glycol monobutyl ether, 10% acetic acid, 24% tall oil fatty acid substituted imidazoline and 24% tallowdiamine with 10 moles ethylene oxide (an ethoxylated fatty diamine). This formulary is designated as CI-1.

The preferred formulary of (B) comprises 64% water and 36% sodium molybdate dihydrate. This formulary is designated CI-2.

The total amount of the combined treatment used in the methods of the present invention is that amount which is sufficient to inhibit corrosion in the aqueous system sought to be treated. This will vary due to conditions such as type of iron metallurgy present, amount and type of sulfur compound present and water temperature.

Preferably, the total amount of the combined treatment may be added to the aqueous system in an amount ranging from about 1 part per million to about 1000 parts per million based on the amount of water to be treated. Most preferably, the total amount of the treatment is from about 5 to 100 parts per million parts water.

The combined treatment can be added to the water by any conventional method. The components can be added separately or as a combination. It is preferred to add the composition as a single treatment composition.

The present invention will now be further described with reference to a number of specific example which are to be regarded solely as illustrative and not as restricting the scope of the invention.

EXAMPLES

Potentiodyne Corrosion Rate Testing

Tests were performed to measure corrosion rate by potentiodyne corrosion rate testing utilizing a Petrolite potentiodyne. After equilibration procedures, corrosion rate measurements are taken until stable readings are obtained. The general corrosion rate is expressed in thousandths of inches of steel corroded per year (mpy). % protection from pitting is defined as (Blank-treatment/Blank)×100%. These results are presented in Tables I and II.

TABLE I

| Treatment (ppm) | Potentiodyne Corrosion Rate Testing Water Injection Header #14 General Corrosion Rate (mpy) | Pitting Corrosion Rate (mpy) | % Protection From Pitting |
|---|---|---|---|
| Blank | 1,191 | 36,000 | — |
| A = I (526) | 354 | 5,000 | 86 |
| II (526) | 505 | 9,000 | 75 |
| 84% A, 16% B (526) | 106 | 1,800 | 95 |

A is CI-1, B is CI-2.
I is 22% $H_2O$, 20% diethylene glycol monobutyl ether, 10% orthophosphoric acid, 24% tall oil fatty acid substituted imidazoline and 24% tallowdiamine w/10 moles ethylene oxide.
II is 22% $H_2O$, 20% diethylene glycol monobutyl ether, 10% acetic acid, 36% tall oil fatty acid substituted imidazoline and 12% tallowdiamine w/10 moles ethylene oxide.

These results indicate that the combination treatment of (A) and (B) is more effective than the use of (A) by itself. The addition of the CI-1 to the CI-2 proves more effective at inhibiting iron corrosion from pitting.

TABLE II

| Treatment (ppm) | Potentiodyne Corrosion Rate Testing Water Injection Header #1363 General Corrosion Rate (mpy) | Pitting Corrosion Rate (mpy) | % Protection From Pitting |
|---|---|---|---|
| Blank | 202 | 4,500 | — |
| A(315) | 76 | 970 | 78 |
| A(315) + B(105) | 85 | 720 | 84 |
| A(210) + B(53) | 172 | 2,400 | 47 |

A is CI-1, B is CI-2.

These results indicate that the combination of A and B is a better corrosion inhibitor than A alone. The low efficacy at iron corrosion resistance in the last example indicate that the treatment concentration is below the threshold level for adequate corrosion inhibition.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. An iron corrosion inhibiting composition comprising a combination of (A) an aqueous solution of an alcohol selected from the group consisting of diethylene glycol monobutyl ether, butanol, butyl cellusolve, isopropanol, methanol, propylene glycol, 2-ethylhexanol, hexylene glycol, and glycolic acid, an acid selected from the group consisting of acetic acid and orthophosphoric acid, a fatty imidazoline prepared by reacting long chain fatty acids and polyamines, and an ethoxylated fatty diamine, and (B) an aqueous solution of a molybdate compound or salt selected from the group consisting of sodium molybdate dihydrate.

2. The composition as claimed in claim 1 wherein said fatty imidazoline is a tall oil fatty acid substituted with diethylenetriamine.

3. The composition as claimed in claim 1 wherein said ethoxylated fatty diamine is a tallowdiamine ethoxylated with 10 moles ethylene oxide.

4. The composition as claimed in claim 1 wherein said aqueous solution of alcohol, acid, fatty imidazoline and ethoxylated fatty diamine are in a weight ratio of 20 to 10 to 24 to 24 with the remainder being water.

5. The composition as claimed in claim 4 wherein said weight ratio is 20 to 10 to 36 to 12 with the remainder being water.

6. The composition as claimed in claim 1 wherein the ratio of A to B ranges from about 10 to 1 to about 1 to 1.

* * * * *